United States Patent [19]

Wildman et al.

[11] 4,438,586

[45] Mar. 27, 1984

[54] GAME DEVICE WITH TEMPLATE FOR ARRANGING OBJECTS

[75] Inventors: John R. Wildman, North Riverside; Jeffrey D. Breslow, Highland Park, both of Ill.

[73] Assignee: Marvin Glass & Associates, Chicago, Ill.

[21] Appl. No.: 342,360

[22] Filed: Jan. 25, 1982

[51] Int. Cl.[3] ..... A63F 7/00

[52] U.S. Cl. ..... 46/1 R

[58] Field of Search ..... 273/46, 22, 86 R; 272/8 R, 8 N; 46/1 R; 116/215, 284, 200

[56] References Cited

U.S. PATENT DOCUMENTS

| | | | |
|---|---|---|---|
| 2,207,206 | 7/1940 | Sekretarski | 273/46 |
| 3,283,439 | 11/1966 | Rosen | 46/1 R |
| 3,300,891 | 1/1967 | Glass et al. | 46/17 |
| 3,315,404 | 4/1967 | Rosen | 46/1 R |
| 4,193,512 | 3/1980 | Buxton et al. | 46/1 R X |
| 4,248,433 | 2/1981 | Soriano | 46/1 R X |

*Primary Examiner*—Richard T. Stouffer
*Assistant Examiner*—William H. Honaker

[57] ABSTRACT

A game apparatus includes a vertically adjustable template with a plurality of openings in a preselected configuration. A plurality of generally elongated objects may be placed in an upstanding orientation on a supporting surface within the openings defined in the template and upon raising of the template, conveniently using a mechanical cam system, the objects are left standing in approximately spaced chain defined by the template configuration. The game apparatus also includes a starting device for engaging one of the objects, causing it to fall into an adjacent object, thereby initiating a chain reaction of objects falling into adjacent objects in an orderly progression. The game apparatus may also include an assembly with a rolling element engaged by a trip member that is tripped by one of the objects. Once tripped, the trip member engages the rolling member which rolls across a surface to engage another of the objects to continue the chain reaction. A bridge may also be included in the game apparatus and allows a row of objects to pass over another row of objects. The game apparatus may also include a device for signaling the end of the chain reaction. This signaling device may include a trip member, a pivotally mounted flat and a weight that pivots the flag to an upright position upon impact of an object against the trip member.

11 Claims, 9 Drawing Figures

10
22
52
54
36
34
26
16
20
14
28
24
68
30
60
72
70
50
46
44

10
3
16
52
54
20
50
70
60
72
36
14
26
46
30
32
68
24

52
22
20
44
14
46
36
26
28
33
32
30
34
47

52
22
20
28
26
46
30
14
34
47
32
33
36
44

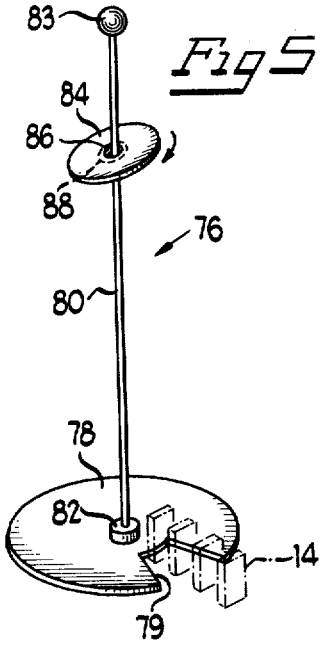
Fig 5
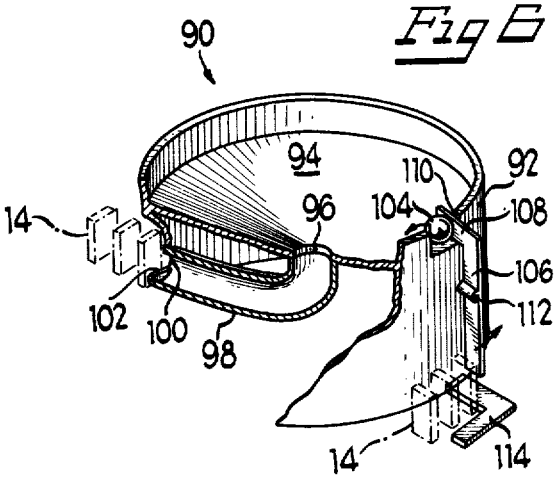
Fig 6
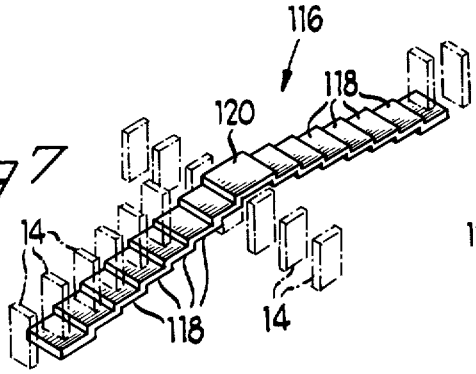
Fig 7
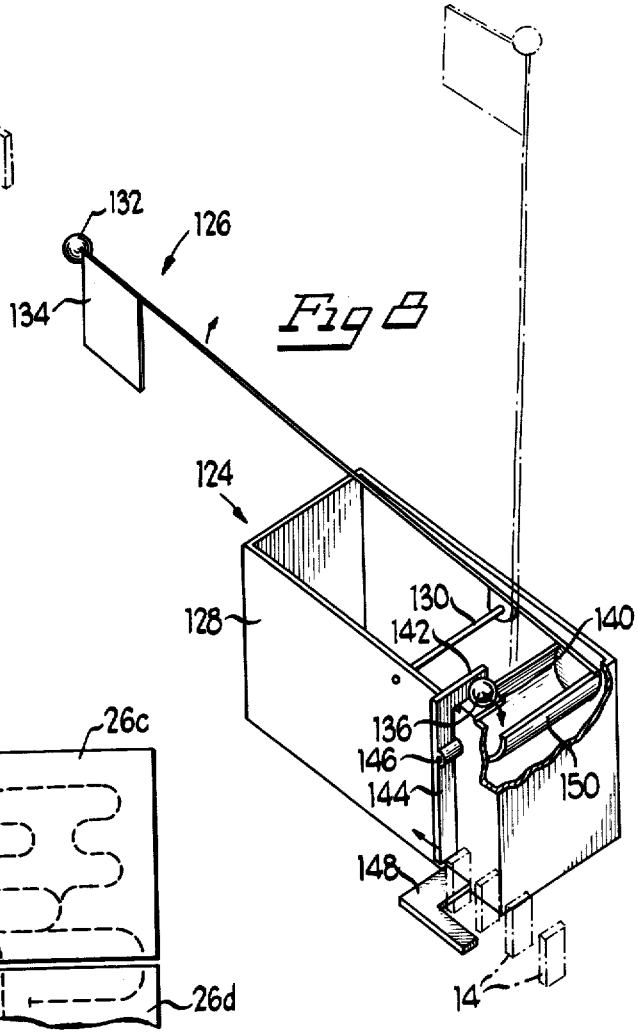
Fig 8
Fig 9
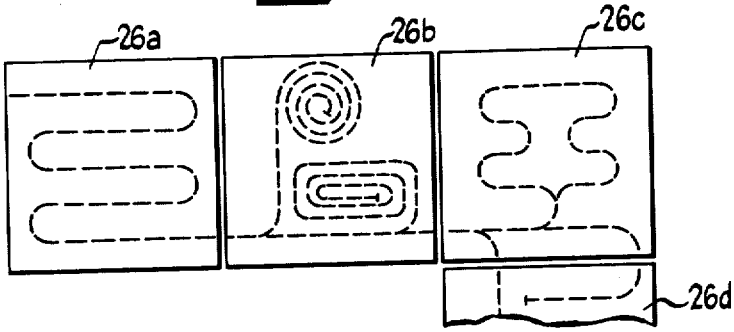

GAME DEVICE WITH TEMPLATE FOR ARRANGING OBJECTS

BACKGROUND OF THE INVENTION

A. Field of the Invention

The present invention relates to a new and improved game apparatus for setting up elongated objects, such as dominos, in predetermined configurations.

B. Description of the Prior Art

Both children and adults enjoy setting up objects such as dominos in predetermined configurations and then through a chain reaction, causing the dominos to fall over sequentially and while falling over, to initiate an entertaining series of events. Not only are dominos set up in this manner for pleasure at home, but there are also contests and groups of people that get together to set up large chains of dominos over a large area and in many different configurations. Apparatus for use in conjunction with such play is described in U.S. Pat. Nos. 3,283,439, 3,283,440, 3,315,404, 3,621,601, 4,047,322 and 4,248,433.

One problem, however, is that often times an individual does not have the ability or the patience to place the dominos in very long, unusual and entertaining configurations. Often the tedium involved in setting up the dominos, an operation which is extremely delicate and often requires repeated efforts to set up an array without accidentally initiating a chain reaction, may exceed the potential enjoyment. Moreover, it would be desirable to have mechanical means for starting and signaling the finish of the chain reaction of falling dominos. It is also desirable to have several different devices in the path of the falling dominos to create different actions and then to continue the chain reaction of the falling dominos onto another chain of dominos. Such items are lacking in the prior art.

BRIEF DESCRIPTION OF THE DRAWINGS

The above and other objects and advantages and novel features of the present invention will become apparent from the following detailed description of a preferred embodiment of the invention illustrated in the accompanying drawings, wherein:

FIG. 5 is a perspective view of a starting device to be used with the present invention;

FIG. 6 is a partially fragmented, perspective view of a device that may be used with the present invention;

FIG. 7 is a perspective view of a bridge that may be used with the present invention;

FIG. 8 is a partially cut away, perspective view of a device for signalling the finish of the falling of a plurality of objects; and FIG. 9 is a reduced top view of several different templates that may be used with the device of the present invention.

DESCRIPTION OF THE PREFERRED EMBODIMENT

Figure 1:
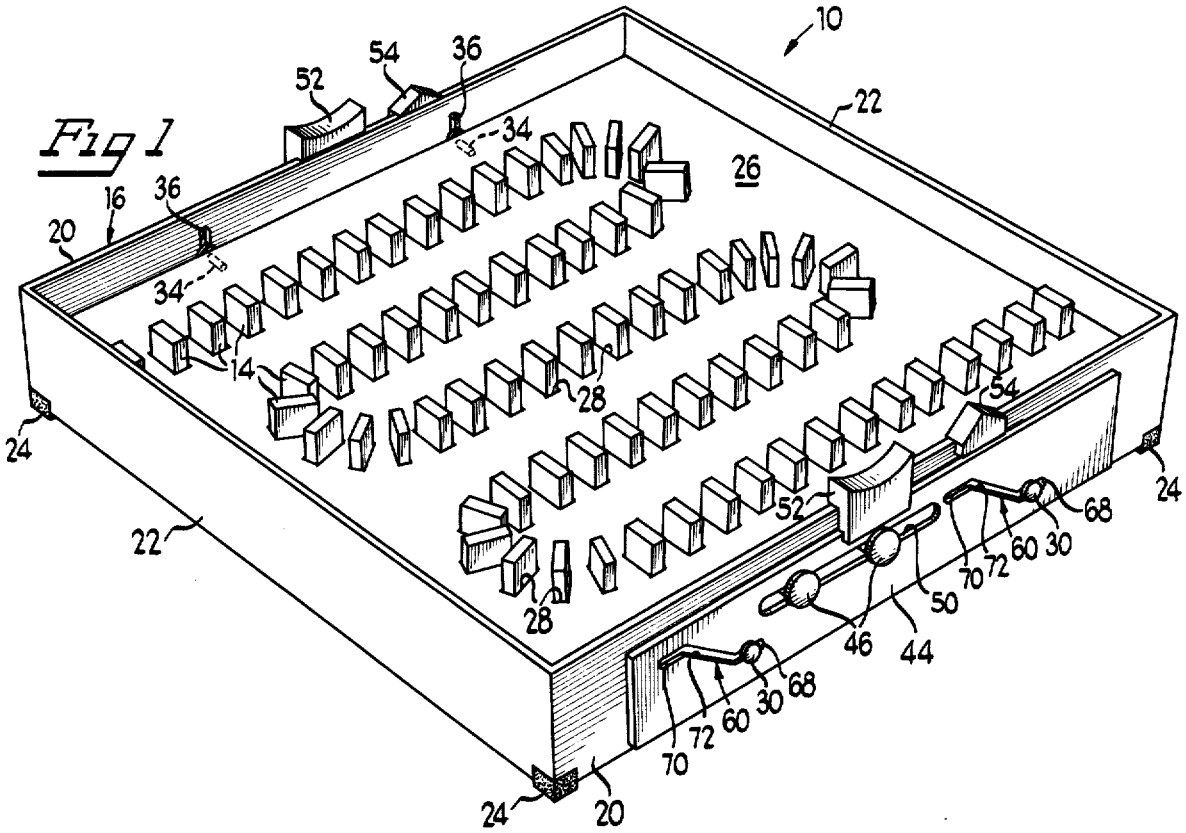
FIG. 1 is a perspective view of a preferred embodiment of a game apparatus constructed in accordance with the principles of the present invention.
Figure 2:
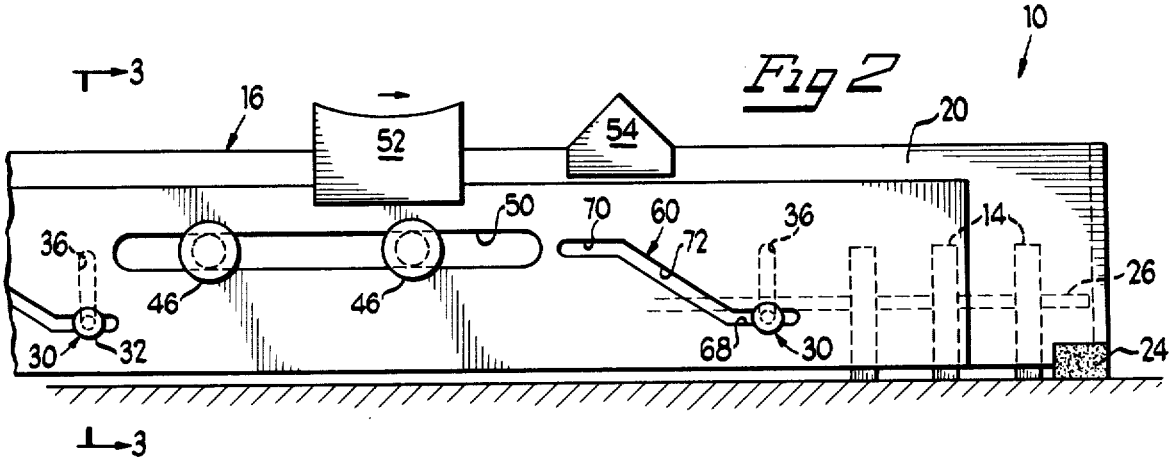
FIG. 2 is a partial side view of the embodiment shown in FIG. 1.

With reference to FIGS. 1–4 of the drawings, there is illustrated a frame and template assembly, generally designated by the reference numeral 10 that may be employed to arrange a plurality of elongated objects such as the dominos 14 in an elaborate array of upright objects, proximately arranged such that each object upon impact tends to fall into and topple over an adjacent object. Once the dominos 14 are set up in the desired configuration by the game apparatus 10, the game apparatus 10 may be removed leaving the dominos 14 free-standing in the predetermined configuration.

The game apparatus 10 includes a frame or housing 16 with sides 20 and 22 defining an open top and bottom. At each of the corners of the housing 16 a leg 24, conveniently a resilient block, extends slightly below the sides 20 and 22 such that the game apparatus 10 will not mar a surface on which the game apparatus 10 is placed, such as a table or a floor. Movably positioned within the housing 16, a removable template 26 includes a plurality of openings or holes 28 that loosely conform to the shape of the dominos 14.

Figure 3:
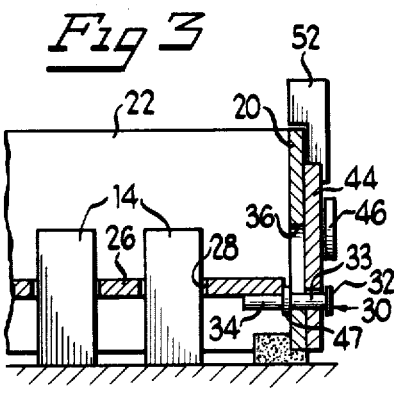
FIG. 3 is a partial cross-sectional view taken along line 3—3 of FIG. 2, with a template in the lowered position.
Figure 4:
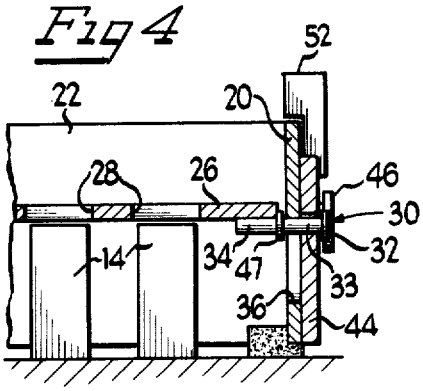
FIG. 4 is a view similar to FIG. 3 with the template in the raised position.

The template 26 is vertically adjustable between the positions shown in FIG. 3 and FIG. 4, through the operation of pairs of spaced pins 30 and 46 and plates 44. The pins 30 extend through spaced, vertically arranged slots 36 defined in each side 20. The pins 30 also extend through a plate 44 on the outside of each side 20. Each pin 30 includes a freely encircling washer 47, an annular flange 32, and a central axis 33, a portion 34 of which extends outwardly of the side 20. The template 26 is removably supported atop the four portions 34. Each pair of a flange 32 and washer 47 sandwich a plate 44 and side 20 between them. The plates 44 are slidably secured to each side 20 by a pair of flanged pins 46 that are rigidly anchored on each side 20 and extend through a horizontally disposed slot 50 defined in the plate 44. The plate 44 is intended to slide horizontally relative to the pins 46 within the slot 50 when a finger engagement member 52 secured to the plate 44, is moved in a horizontal direction. To assist in moving the plate 44 by the finger engagement member 52, a grasping member 54 is rigidly mounted on the top of each side 20 at a point spaced from the member 52 so that the members 52 and 54 may be squeezed toward one another by a different finger on the same hand of the user of the game apparatus 10.

The plate 44 translates its horizontal movement along a side 20 into vertical movement of the pins 30 through the employment of the generally inclined Z-shaped slots 60 in the plate 44. The slots 60 include upper and lower horizontal portions 68 and 70, connected by inclined slot portions 72.

The pins 30 are initially in the position illustrated in FIG. 3, whereupon the template 26 is in the lower position conveniently arranged generally about the middle of the objects 14 which may be inserted into the openings 28 to rest on a surface, such as a table top or the like. When the plate 44 is moved horizontally by squeezing the finger engagement member 52 toward the grasping member 54, the pins 30 are cammed up the inclined slot portions 72 until they rest in the horizontal slot portions 70. In this position, the pins 30 are located in their uppermost position as illustrated in FIG. 4 such that the pins 30 are at the top of the slots 36. The template 26 is then in a position, shown in FIG. 4, above the dominos 14. Thus, the game apparatus 10 may be lifted vertically upward and away from the dominos without disturbing the dominos leaving the dominos 14 in a standing position in the configuration of the holes 28 in the template 26.

The game apparatus 10 allows alignment of the dominos 14 in a predetermined configuration such that the dominos 14 are not accidentally toppled during placement causing an undesired chain reaction. Also, the user of the toy apparatus 10 can be sure of the alignment of the dominos 14 in the proper positions, spaced from each other as well as properly located to insure a complete chain reaction throughout the chain or configuration of the dominos 14. Moreover, the mechanism makes it possible to use dominos of much smaller size than conventional dominos.

Since the templates 26 are removable from the housing 16, templates having different patterns of holes 28, such as the templates 26*a–d* in FIG. 9, may be used replaceably in the housing 16 to create highly complex and unique domino configurations. The pattern of dominos produced by one template 26 conveniently communicates with that produced by one or more other templates 26 to produce a composite pattern of unending variety.

Referring to FIG. 5, there is illustrated a starting device, generally designated by the reference numeral 76 which provides a short time delay before the start of the domino chain reaction thereby providing excitement. The starting device 76 includes a base 78 with a notch 79 therein to allow the positioning of dominos 14 near the center of the base 78. Located at the approximate center of the base 78 is a post 80 that is mounted in an attachment block 82 secured to the center of the base 78. The post 80 includes, at its upper end thereof, a metal ball 83. Mounted on the pole 80 is a washer or annular member 84 with a central aperture or hole 86. An annular magnet 88 encircles the hole 86 such that the annular member 84 may be lifted to engage and be attracted to the ball 83 by the magnet 88. When it is desired to start the falling chain reaction of the dominos 14, the washer 84 is pushed downwardly away from the ball 83 until the magnetic attraction is broken. Thereafter, the washer 84 slides down the pole 80 until it engages the mounting block 82. A domino 14 is positioned against the back of the slot 79 so as to be engaged by the washer 84 when it falls and engages the mounting block 82, thereby starting the falling chain reaction of the dominos 14.

Located within a pattern or configuration of the dominos 14, a device 90, illustrated in FIG. 6, includes a circular housing 92 with a concave upper surface 94 defined within the housing 92 and located slightly below the top thereof. A central aperture 96 defined in the upper concave surface 94 is connected to a tube 98 that communicates with an opening 100 defined in the side of the housing 92. At the end of the tube 98 near the opening 100 is a lip 102. A ball bearing 104 is positioned within and adjacent to an L-shaped trip member 106 with a foot or horizontal extension 108 of the trip member 106 extending through a slot 110 in the upper end of the housing 92 against which the ball bearing 104 is positioned. The trip member 106 is pivotally mounted by a pin 112 that is mounted in the housing 92. An L-shaped edge 114 extends outwardly from the housing 92 and is of a dimension approximately equal to the width of a domino 14. The dominos 14 may extend into the L-shaped edge 114 and butting thereagainst as illustrated in FIG. 6. In this manner, as illustrated, the last domino 14 falls against the trip member 106 causing it to pivot about the pin 112. This action causes engagement of the ball bearing 104 by the horizontal portion 108 of the trip member 106 causing it to roll around the concave surface 94 eventually falling through the hole 96 passing along the tube 98 and coming to rest against the lip 102. As illustrated in FIG. 6, another line of dominos 14 is aligned against the opening 100 such that the ball bearing, upon engaging the lip 102, engages a domino 14 and continues the chain reaction of falling dominos.

The device 90 functions to provide a visual delay between the toppling of one domino pattern and the inception of toppling of another pattern, providing much excitement. However, a variety of housings could be used for this purpose in place of the circular housing 90, with its concave upper surface 94. For example, a housing (not shown) with a U-shaped upper surface which receives a ball or other rolling member on a high point of the curved surface may be arranged to deliver the ball through its central low point to begin the toppling of another domino chain. The ball would then roll back and forth on the upper surface until it slowed sufficiently to pass out of an opening at the low point of the upper surface.

Another device which may be located along the domino pattern is illustrated in FIG. 7 and generally designated by the reference numeral 116. The device 116 is a bridge with individual steps 118 extending from two sides up to a top step 120. As illustrated in FIG. 7, individual dominos 14 may be positioned on each of the steps 118 and 120. In addition, the step 120 is of a height and dimension so as to allow a line of dominos 14 to pass thereunder. As can be understood my one skilled in the art, the chain reaction of falling dominos may continue over the bridge 116 while a similar chain reaction of falling dominos occurs under the bridge 116 and specifically under the step 120.

A device to signal the finish of a chain reaction of falling dominos 14 is illustrated in FIG. 8 and generally designated by the reference numeral 124. The signaling device 124 employs a flag 126 that is pivotally mounted to a housing 128 by a pin 130. As illustrated in FIG. 8, the flag 126 includes a ball 132 at the upper end thereof and a pennant 134. In the position illustrated in the solid lines in FIG. 8, the flag 126 is in a down position. When the last domino 14 has fallen, it is intended that the flag 126 be pivoted to the vertical position illustrated in dotted lines in FIG. 8. This pivoting of the flag 126 is accomplished through the employment of a weighted element such as the ball bearing element 136. The ball bearing element 136 is mounted on a shelf 140 secured to the housing 128 in a position such that the ball bearing element 136 is adjacent to a horizontal portion 142 of a trip member 144. The trip member 144 is pivotally secured to the housing 128 by a pin 146 and includes a portion extending downwardly and adjacent to an L-shaped edge 148 that is of a sufficient dimension to allow positioning of dominos 14 therein abutting the edge 148 and adjacent to the downwardly extending portion of the trip member 144. As can be understood by one skilled in the art, as the last domino 14 abutting the edge 148 falls it will engage the trip member 144 causing it to pivot about the pin 146 such that the horizontal portion 142 engages the ball bearing element 136 forcing it out of the shelf 140 and into a catch member 150 that is secured to the bottom or lower end of the flag 126. The additional weight of the ball bearing element 136 causes the flag 126 to pivot about the pin 130 to the vertical position signaling the end of the chain reaction of falling dominos 14.

It will be understood that the above description of a specific embodiment is by way of illustration only and is not to be construed as limiting the present invention to the specific embodiment described herein.

What is claimed and sought to be secured in Letters Patent of the United States is:

1. A game device for arranging objects in a predetermined configuration, comprising:

a plurality of objects;

a frame, a template removably mounted in said frame, said template including a plurality of openings that receive said objects, said openings arranged in said predetermined configuration; and means for moving said template from a first position supporting said objects to a second position spaced from said objects including a finger engaging member and a grasping member, said moving means being actuated by squeezing said finger engaging member and grasping member together.

2. The game apparatus set forth in claim 1 further comprising means for signaling a finish in proximity to one of said objects including a stand, a flag pivotally mounted on said stand, a weight on said stand, means actuated by said weight to pivot said flag, and trip means engageable by one of said objects to move said weight to actuate said means actuated by said weight.

3. The game device claimed in claim 1 further comprising means for causing said objects to fall in a chain reaction including a base, a pole secured to said base and a magnetized member slideably mounted on said pole.

4. The game device claimed in claim 1 further comprising means for signaling the end of a falling chain reaction of said objects including a housing, a flag pivotally mounted on said housing, a shelf on said housing, a weight on said shelf, a weight holding member on said flag, a weight engagement member pivotally mounted on said housing in proximity to one of said objects.

5. The game apparatus of claim 1 including:

means for communicating the falling action of said objects in chain reaction from one object to another object, said communicating means including means for providing a time delay between the falling of one object and the falling of the other object; and said communicating means including a housing with a curved surface having a high and a low portion, a first hole in the said surface, a second hole in said housing, a path coupling said first and second holes, a ball locatable on said curved surface, and a trip member pivotally mounted on said housing, arranged to displace said ball onto said curved surface near the high portion thereof, said first hole located near the low portion of said curved surface.

6. The game apparatus of claim 1 wherein:

said moving means includes means for displacing said template vertically, said displacing means including a horizontal displaceable actuator; and said actuator is a plate having a pair of spaced Z-shaped slots therein and a pin for each slot, each pin extending through said frame by way of a generally vertical slot in said frame so as to support said template.

7. A game device for arranging objects in a predetermined configuration, comprising:

a plurality of objects;

a frame;

a template removably mounted in said frame, said template including a plurality of openings that receive said objects, said openings arranged in said predetermined configuration;

means for moving said template from a first position supporting said objects to a second position spaced from said objects including means for displacing said template vertically; and a horizontal displaceable actuator included in said displacing means with said actuator being a plate having a pair of spaced Z-shaped slots therein and a pin for each slot, each pin extends through said frame by way of a generally vertical slot in said frame so as to support said template.

8. The game device claimed in claim 7 further comprising means for causing said objects to fall in a chain reaction including a base, a pole secured to said base, and a magnetized member slidably mounted on said pole.

9. The game device claimed in claim 7 further comprising means for signaling the end of a falling chain reaction of said objects including a housing, a flag pivotally mounted on said housing, a shelf on said housing, a weight on said shelf, a weight holding member on said flag, and a weight engagement member pivotally mounted on said housing in proximity to one of said objects.

10. The game apparatus of claim 7 including:

means for communicating the falling action of said objects in chain reaction from one object to another object;

said communicating means including means for providing a time delay between the falling of one object and the falling of the other object; and said communicating means further including a housing with a curved surface having a high and a low portion, a first hole in the said surface, a second hole in said housing, a path coupling said first and second holes, a ball locatable on said curved surface, and a trip member pivotally mounted on said housing, arranged to displace said ball onto said curved surface near the high portion thereof, said first hole located near the low portion of said curved surface.

11. The game apparatus set forth in claim 7 further comprising means for signaling a finish in proximity to one of said objects including a stand, a flag pivotally mounted on said stand, a weight on said stand, means actuated by said weight to pivot said flag, and trip means engageable by one of said objects to move said weight to actuate said means actuated by said weight.

* * * * *